US005081981A

United States Patent [19]

Beal

[11] Patent Number: 5,081,981

[45] Date of Patent: Jan. 21, 1992

[54] YELLOW FLAME GAS FIREPLACE BURNER ASSEMBLY

[75] Inventor: Thomas J. Beal, Ossian, Ind.

[73] Assignee: Majco Building Specialties, L.P., Huntington, Ind.

[21] Appl. No.: 550,116

[22] Filed: Jul. 9, 1990

[51] Int. Cl.[5] ..... F24C 3/04

[52] U.S. Cl. ..... 126/92 R; 126/512; 431/125

[58] Field of Search ..... 431/125, 110, 112; 126/540, 555, 500, 512, 90, 92 R, 85 R, 91 R, 86

[56] References Cited

U.S. PATENT DOCUMENTS

| | | | |
|---|---|---|---|
| 3,543,741 | 12/1970 | Whitehead | 126/92 |
| 4,110,063 | 8/1978 | Mitchell | 431/125 |
| 4,828,485 | 5/1989 | Jankowski | 431/125 |
| 4,838,240 | 6/1989 | Rieger | 431/125 X |
| 4,875,464 | 10/1989 | Shimek et al. | 126/92 R |
| 4,886,445 | 12/1989 | Richardson | 126/298 |
| 4,976,253 | 12/1990 | Beal et al. | 126/92 R |
| 5,000,162 | 3/1991 | Shimek et al. | 126/92 R |

*Primary Examiner*—Larry Jones
*Attorney, Agent, or Firm*—Hoffmann & Baron

[57] ABSTRACT

A gas fireplace burner assembly which produces a yellow flame and simulates the appearance and pattern of the yellow flames produced by a natural wood log fire includes a log grate for supporting a plurality of artificial logs. The log grate is formed with a stepped configuration and has a back wall and opposite side walls, each of which has an opening formed through its thickness to allow secondary air to pass therethrough and into an interior space defined by the walls of the log grate. The log grate also includes a slotted grate front member. At least a front and rear artificial log is supported on the log grate. A burner tube is also supported by the log grate and has front and rear portions which are disposed in parallel. A front flame deflector is interposed between and spaced apart from the grate front member and the front portion of the burner tube and defines first and second channels for secondary air to flow through. Artificial ember material is situated adjacent to the front burner tube portion and is further situated so as to be adapted to come in contact with flames emanating from the front burner tube portion. A rear flame deflector is at least partially superposed over the rear burner tube and has a plurality of flame openings formed in it. A gas control assembly controls the passage of gas through the burner tube, and includes a gas valve which communicates with the burner tube and which can be coupled to a source of gas.

10 Claims, 6 Drawing Sheets

YELLOW FLAME GAS FIREPLACE BURNER ASSEMBLY

BACKGROUND OF THE INVENTION

1. Field of the Invention

The present invention relates generally to a gas burner assembly, and more particularly relates to a burner assembly for burning natural gas or LP gas and which is adapted for use in a fireplace. Even more specifically, the present invention relates to a gas fireplace burner assembly which is capable of creating an essentially yellow flame pattern similar in appearance to yellow flames naturally formed in a real wood log fire with acceptable levels of carbon monoxide production.

2. Description of the Prior Art

Gas fireplace units have long been used as a substitute for real log or coal fires because of their convenience. The flames are produced by gas, either natural gas or liquid petroleum (LP) gas and the logs, while having the appearance and texture of real wood logs, are of a permanent non-combustible material.

The problem with all gas fireplace burner assemblies has been to produce a clean yellow flame. A clean blue flame is produced by mixing primary air with the gas before it is burned, thereby providing complete combustion and producing a clean flame. However, to make the flame yellow requires the elimination or reduction of the amount of primary air with only secondary air, air that mixes with the gas just at the base of the flame, to produce combustion. Examples of gas fireplace burners which are stated to produce a yellow flame are disclosed in U.S. Pat. No. 3,760,790 to Voges et al., U.S. Pat. No. 4,838,240 to Rieger, and U.S. Pat. No. 4,883,043 to Thow et al.

Many conventional gas fireplace units suffer from incomplete combustion. This may be due to insufficient secondary air, the uncontrolled direction of the secondary air in the burner or the flames impinging on the artificial logs used in the gas fireplace unit. The result is a yellow but very dirty flame producing carbon monoxide, soot and other forms of pollution, the soot collecting on the logs or other fuel substance on which the flames impinge.

OBJECTS AND SUMMARY OF THE INVENTION

It is an object of the present invention to provide a fireplace gas burner assembly for producing an essentially yellow flame pattern having an appearance similar to the yellow flame that is produced by a natural wood log fire.

It is another object of the present invention to provide a burner assembly for use in a gas fireplace which produces virtually no carbon monoxide gas.

It is yet another object of the present invention to provide a yellow flame gas fireplace burner assembly which produces not only the effect of glowing embers but also a yellow flame pattern situated in front of the most forward log.

It is a further object of the present invention to provide a fireplace gas burner assembly which produces a highly visible and authentic yellow flame.

It is still another object of the present invention to provide a yellow flame gas fireplace burner assembly which overcomes the inherent disadvantages of conventional gas fireplace units.

In accordance with one form of the present invention, a gas fireplace burner assembly which produces a yellow flame includes a log grate for supporting a plurality of artificial logs. The log grate is formed with a stepped configuration and has a back wall and opposite side walls joined to the back wall. Each of the back wall and opposite side walls has an opening formed through its thickness. The openings are dimensioned to allow sufficient secondary air to pass through the walls and into an interior space defined by the back wall and the opposite side walls. The log grate further includes a grate front member situated opposite the back wall.

The gas fireplace burner assembly further includes at least a front and a rear artificial log. The front and rear artificial logs are mounted on the log grate and supported by the grate. The logs are arranged generally parallel with each other.

A burner tube is also included. The burner tube has interconnected front and rear portions which are disposed in a spaced apart, parallel arrangement. The rear portion is disposed at least partially below and between the front and rear logs, and the front portion is disposed at least partially below and between the grate front member and the front log.

The gas fireplace burner assembly of the present invention further includes a front flame deflector. The front flame deflector has an elongated plate-like member interposed between and spaced apart from the grate front member and the front portion of the burner tube. The front flame deflector and the grate front member, and the front flame deflector and the front burner tube portion define first and second channels, respectively, for secondary air to flow through.

The gas fireplace burner assembly further includes artificial ember material. The artificial ember material is situated adjacent to the front burner tube portion and is further positioned with respect to the front burner tube portion so that flames emanating from the front burner tube portion impinge on the artificial material to cause it to glow.

A rear flame deflector is further included. The rear flame deflector is at least partially superposed over the rear burner tube portion, and has a plurality of flame openings formed in it. The rear flame deflector and rear burner tube portion define a third channel for secondary air to flow through.

The gas fireplace burner assembly of the present invention further includes a gas control assembly for controlling the passage of gas through the burner tube. The gas control assembly has a gas valve which communicates with the burner tube and which is adapted to be coupled to a source of gas.

These and other objects, features and advantages of this invention will be apparent from the following detailed description of illustrative embodiments thereof, which is to be read in connection with the accompanying drawings.

DETAILED DESCRIPTION OF THE PREFERRED EMBODIMENTS

Figure 1:
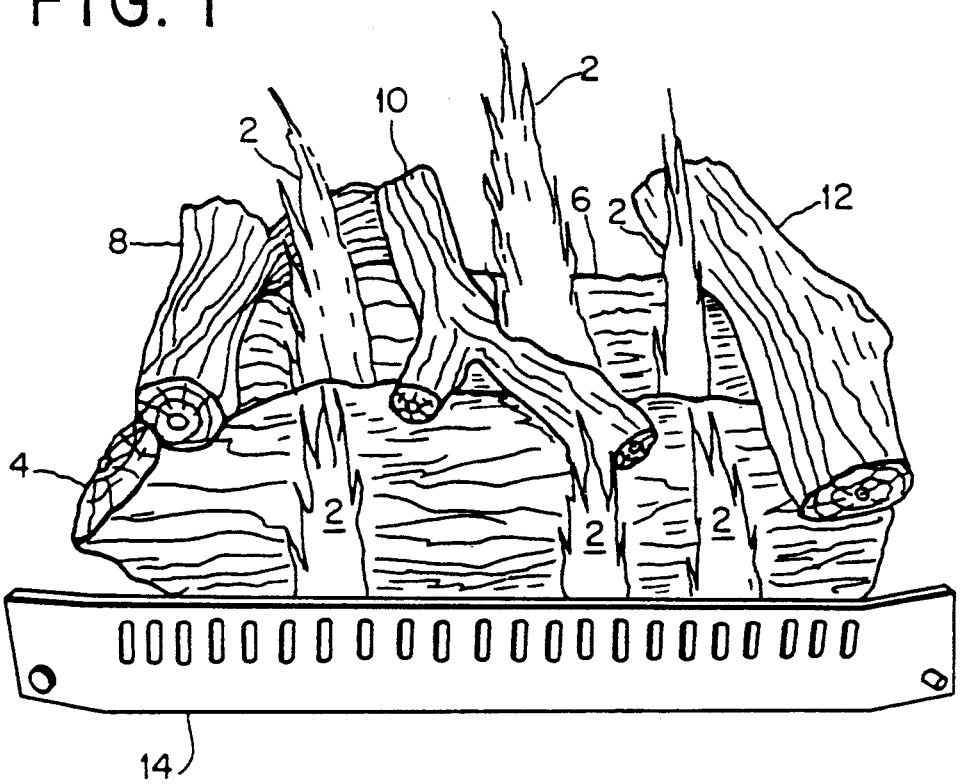
FIG. 1 is a perspective view of a gas fireplace burner assembly formed in accordance with the present invention and illustrating its general appearance when operating and with artificial logs in place.

Referring initially to FIG. 1 of the drawings, it will be seen that a gas fireplace burner assembly constructed in accordance with the present invention is designed to provide a plurality of separate yellow flames 2 of different heights and widths between the artificial logs of the assembly. Two rather large front and rear artificial logs 4, 6 appear to support smaller logs 8, 10, 12 of various shapes mounted transversely across the front and rear logs. The yellow flames 2 are visible between the transversely mounted logs 8-12 as well as between the front and rear logs 4, 6, and also in front of the front log. Each of the logs is formed from a non-combustible material.

Also, in the preferred form of the invention, the rear log 6 is supported at a level above the front log 4 so that the rear log is visible and not obscured from view by the front log and so that the transversely disposed logs 8–12 are also sloping downwardly from back to front and are thus more visible to the viewer.

Also, the gas fireplace burner assembly of the present invention includes material situated at the front of the burner assembly which glows when heated to give the appearance of burning embers underneath the artificial logs. The burning ember material is clearly visible through slots formed in the log grate front member 14, as will be described in greater detail.

The particular layout of the artificial logs, the positioning of the yellow flames between the logs and forward of the front log and the glow given off by the burning ember material create the ambiance and authenticity of a real log burning fireplace.

Figure 4:
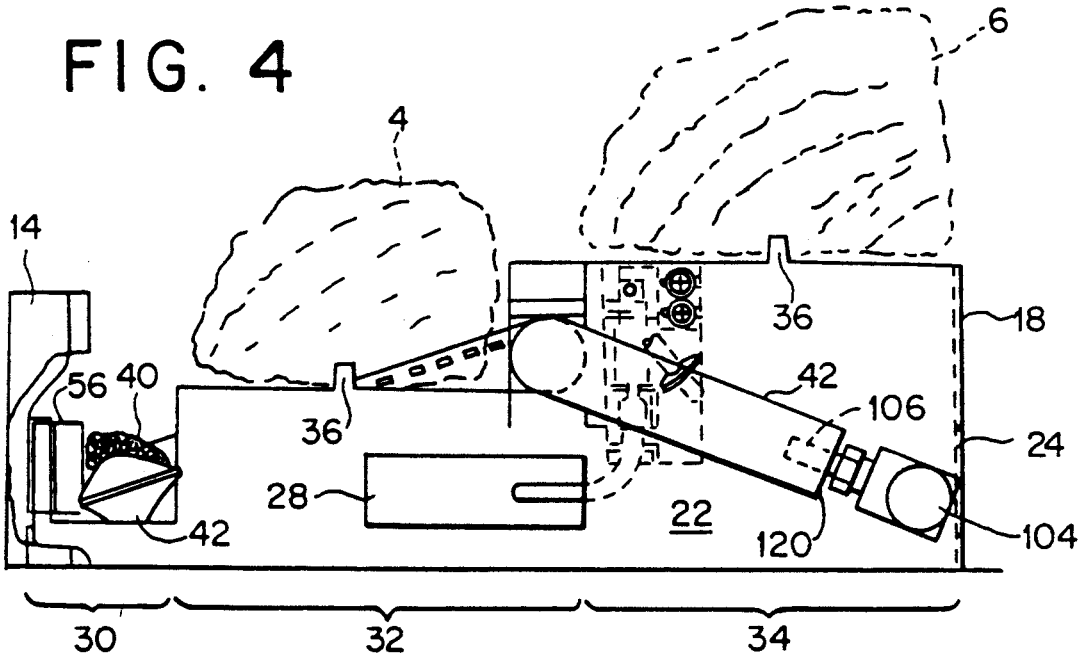
FIG. 4 is a side view of the assembly with some of the artificial logs used in the assembly shown in phantom.
Figure 2:
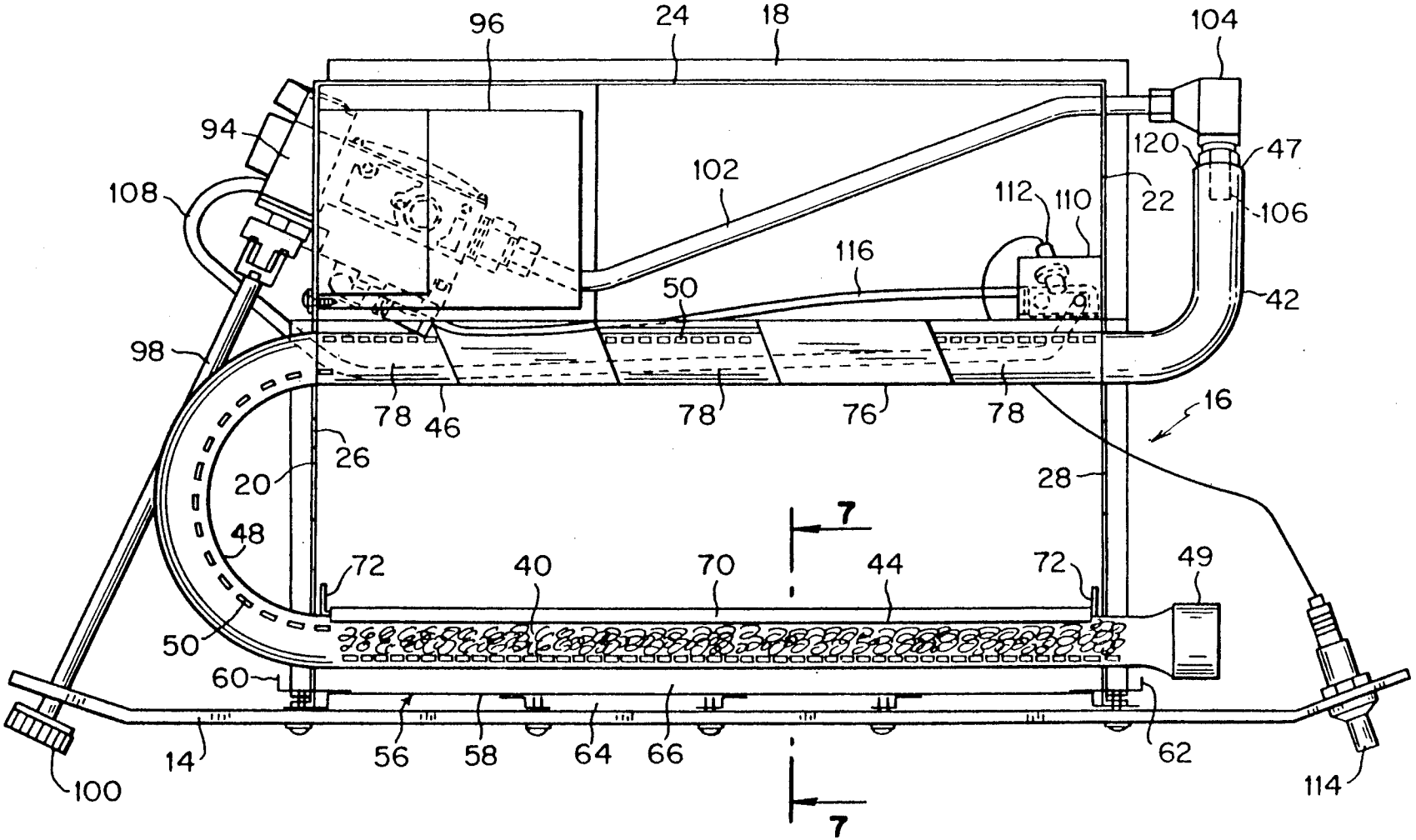
FIG. 2 is a top plan view of the assembly with the artificial logs removed.
Figure 9:
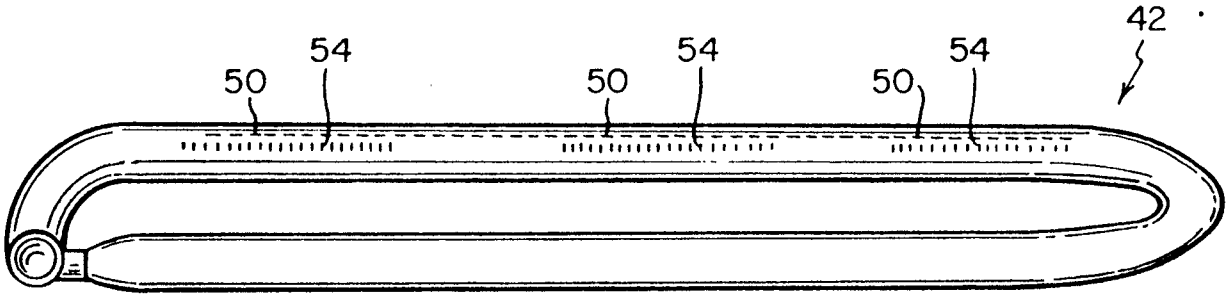
FIG. 9 is a rear perspective view of the burner tube shown in FIG. 8.
Figure 3:
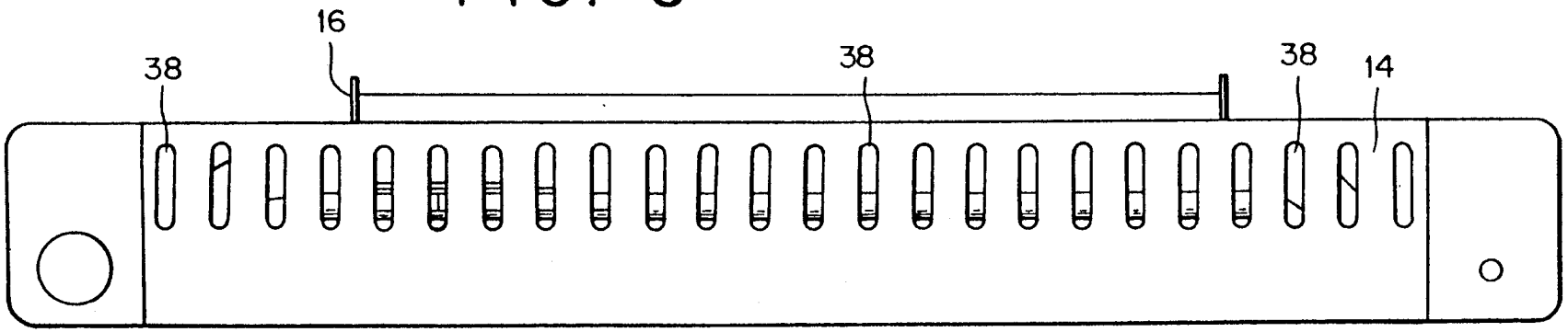
FIG. 3 is a front view of the assembly with the artificial logs removed.

Referring now to FIGS. 2–4 of the drawings, it will be seen that the gas fireplace burner assembly of the present invention includes a log grate 16. The log grate 16 is provided for supporting a plurality of artificial logs 4–12.

The log grate 16 is preferably formed with a stepped configuration. It may be formed from a single blank of sheet metal which is bent in a U-shaped configuration to define a back wall 18 and opposite left and right side walls 20, 22 joined to the back wall.

Each of the back wall 18 and opposite side walls 20, 22 has an opening 24, 26, 28 formed through its thickness. The openings 24–28 are dimensioned to allow sufficient secondary air to pass through the openings and into an interior space of the grate defined by the back wall 18 and the opposite left and right side walls 20, 22. The secondary air mixes with the gas provided to the burner assembly and aids in the combustion process.

Each of the left and right side walls 20, 22 includes successively a front, middle and rear portion 30, 32, 34. Each of the front, middle and rear portions 30–34 has a different height. The front portion 30 is lower than the middle portion 32, and the middle portion 32 is lower than the rear portion 34. This provides the log grate with the overall stepped configuration, increasing in height from front to back.

The middle and rear portions 32, 34 of the left and right side walls support the main front and rear artificial logs 4, 6, respectively, and, as will be described in greater detail, the front and middle portions 30, 32 of the side walls of the grate support front and rear portions of a burner tube used in the burner assembly of the present invention.

Each of the middle and rear portions 32, 34 of the left and right side walls includes an upstanding tab or protrusion 36 extending from its upper surface. The tabs 36 are received by holes (not shown) formed partially into the main front and rear artificial logs 4, 6 to hold the logs in place on the side walls 20, 22. The stepped configuration of the log grate 16 supports the rear log 6 at a level which is at least partially above the front log 4 so that both logs are clearly visible to the viewer, and provides a more realistic appearance to the fireplace.

The log grate 16 further includes a grate front member 14. The grate front member 14 is situated opposite the back wall 18 and is joined to the left and right side walls 20, 22. The grate front member has a plurality of vertical, spaced apart slots 38 formed through its thickness. The slots 38 are provided so that the glowing ember material 40 employed in the burner assembly will be visible to the viewer.

The gas fireplace burner assembly of the present invention further includes a burner tube 42. The burner tube 42 has an overall U-shaped configuration with front and rear portions 44, 46 disposed in a spaced apart, parallel arrangement and interconnected by a curved burner section 48. The tube includes an open end 47 and an opposite sealed end 49. As mentioned previously, the burner tube is mounted on and supported by the log grate 16.

As shown in FIG. 4 of the drawings, the rear portion 46 of the burner tube is disposed at least partially below and between the front and rear logs 4, 6, and the front portion 44 is disposed at least partially below and between the grate front member 14 and the front log 4.

Referring now to FIGS. 8–11 of the drawings, it will be seen that the burner tube 42 has a plurality of ports 50 of a first type formed through the wall of the tube which the gas in the tube flows out of. The tube is substantially cylindrical in cross section, and the ports are formed in the tube at about a 45° angle from the vertical on the rear side of rear burner tube portion 46, and at about a 65° angle from the vertical on the front side of front burner tube portion 44.

Figure 10:
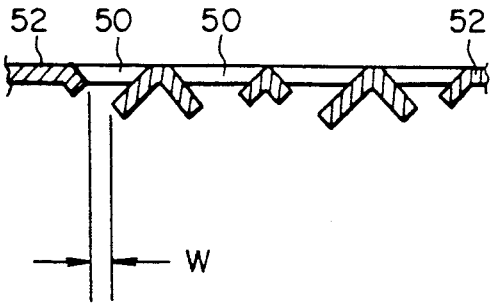
FIG. 10 is a detailed sectional view of the burner tube shown in FIG. 8 taken along line 10—10.
Figure 11:
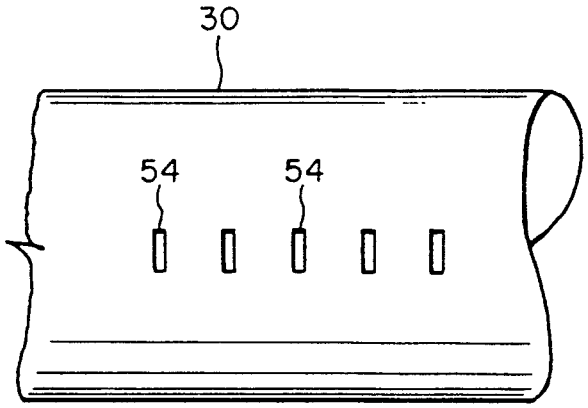
FIG. 11 is an enlarged view of a portion of the burner tube shown in FIG. 9.

A detailed view of the ports 50 of the burner tube is shown in FIG. 10. The ports are formed by lancing the tube so that portions of the tube wall 52 are forced inwardly of the burner tube.

Figure 8:
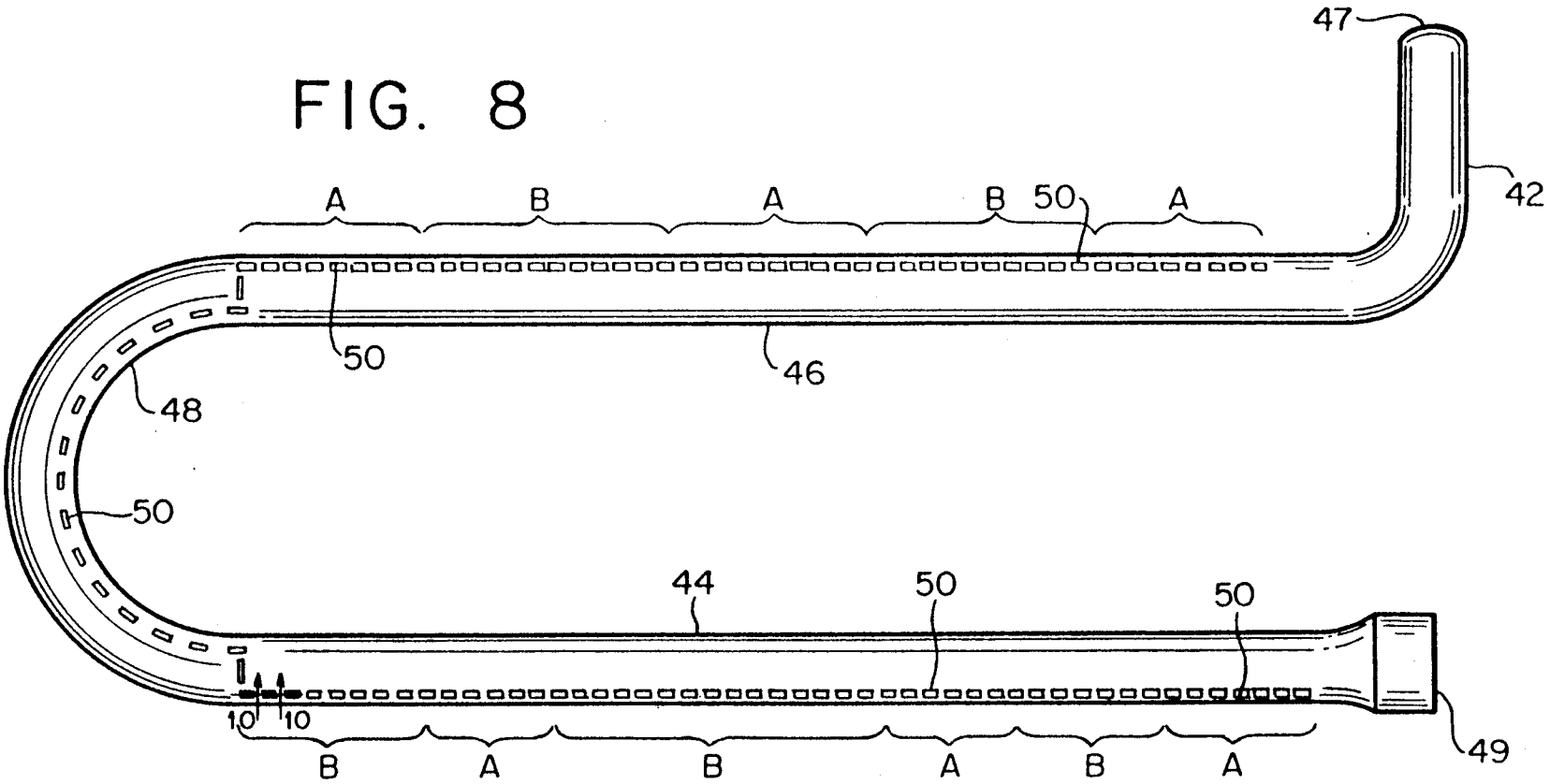
FIG. 8 is top view of a burner tube employed in the burner assembly of the present invention.

In order to help create three yellow flames between the front and rear artificial logs and in front of the front log, the ports 50 are formed over three separated sections, indicated by the letter A in FIG. 8, on the front and rear portions 44, 46 of the burner tube and have a width W which is greater than the width of the ports in other sections, indicated in FIG. 8 by the letter B, of the front and rear burner tube portions so that a greater amount of gas flows out of the ports located in sections A than in sections B. The typical width W of the section A ports is about 0.045 inches, whereas the typical width W of the section B ports is about 0.027 inches. The ports 50 formed in the curved section 48 interconnecting the front and rear portions of the burner tube have the same configuration as the ports formed in the front and rear portions and have a width which is typically about 0.035 inches, and are formed at about a 45° angle from the top of the tube on the inside curvature of the tube.

As will be explained in greater detail, additional ports 54 are formed through the thickness of the rear burner tube portion wall in three spaced apart sets. These ports 54 are disposed below the ports 50 previously described at about 60° to about 65° from the vertical on the rear side of portion 46, and are provided for increasing the height of the three flames emanating from the rear burner tube portion. As shown in greater detail in FIG. 11, these ports 54 are slightly elongated slots formed transversely in the burner tube and spaced apart from each other typically a distance of about 0.188 inches. The slots have a length of about 0.125 inches and a width of about 0.035 inches.

The gas fireplace burner assembly of the present invention further includes a front flame deflector 56. The front flame deflector includes an elongated plate-like member 58 which is interposed between and spaced apart from the grate front member 14 and the front portion 44 of the burner tube. The front flame deflector 56 may also include left and right end deflectors 60, 62 which are mounted on opposite ends of the elongated plate-like member and which include portions extending inwardly toward the front burner tube portion.

Figure 7:
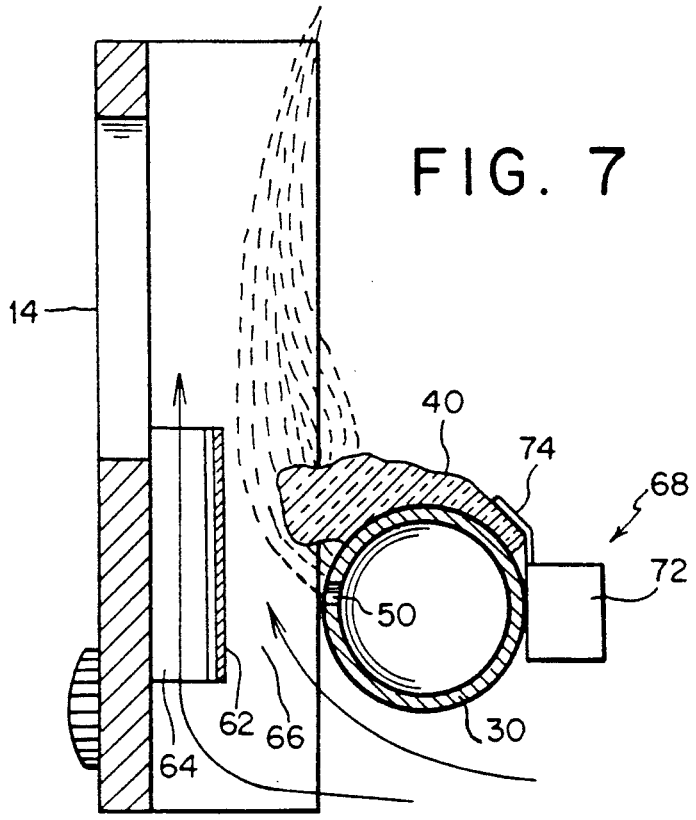
FIG. 7 is a detailed sectional view of a portion of the burner assembly shown in FIG. 2 taken along line 7—7.

As shown in FIG. 7 of the drawings, the elongated plate-like member 58 of the front flame deflector defines between it and the grate front member 14 a first channel 64, and defines between it and the front burner tube portion 44 a second channel 66. The first and second channels 64, 66 are provided for the passage of secondary air from the interior space of the log grate 16 through the burner assembly. This flow of secondary air helps produce a clean yellow flame from the front burner tube portion 44, and helps shape the yellow flame to ensure that the flame does not impinge on or roll over the front portion of the front artificial log 4.

The particular positioning of the front flame deflector 56 is also important for another two reasons. First, the deflector keeps the front flames from impinging on the slotted grate front member 14, which could cause the production of carbon monoxide gases and other pollutants. Because room temperature is on one side of the grate front member 14 and the burner tube and flames are on the other side at a higher temperature, the difference in temperatures would have tended to quench the flames, producing carbon monoxide and carbon, if the flames were allowed to impinge on the grate front member.

Second, the position of the deflector 56 in relation to the front burner tube portion 44 is such that the flames emanating from the burner tube impinge on the flame deflector. As its name implies, the flame deflector directs the yellow flame upwardly and maintains the shape of the yellow flame.

The front flame deflector 56 is preferably made from a stainless steel material which can accept high temperatures. The stainless steel material keeps the flame deflector hot and the temperatures high on the burner tube side of the grate front member 14. This further aids in shaping the yellow flame produced from the front burner tube portion 44.

As mentioned previously, the gas fireplace burner assembly of the present invention also includes an artificial ember material 40. The artificial ember material is preferably a ceramic wool or the like which glows when heated. The material is situated adjacent to the front burner tube portion 44 and is further positioned with respect to the front burner tube portion so as to be adapted to come in contact with flames emanating from the front burner tube portion to cause the artificial ember material to glow.

As can be seen from FIG. 7 of the drawings, the ember material 40 rests on an upper portion of the front burner tube portion 44 and is in contact with the flames emanating from the ports 50 formed in the front burner tube portion. This will ensure that the ember material is exposed to the flames and heated sufficiently to glow. The glowing ember material is visible to the viewer through the slotted grate front member 14.

The gas fireplace burner assembly further includes an ember hold down bracket 68. The ember hold down bracket 68 includes an elongated plate-like member 70 having end tabs 72 mounted on each end of the member and protruding inwardly of the burner assembly. The ember hold down bracket 68 further includes a cantilevered arm 74 extending from the elongated plate-like member 70 and disposed tangential to the circumference of the front burner tube portion 44. The ember material is held in place between the front burner tube portion and the cantilevered arm 74 of the ember hold down bracket.

The gas fireplace burner assembly of the present invention further includes a rear flame deflector 76. The rear flame deflector 76 is at least partially superposed over the rear burner tube portion 46 and includes a plurality of flame openings 78 formed in it.

Figure 5:
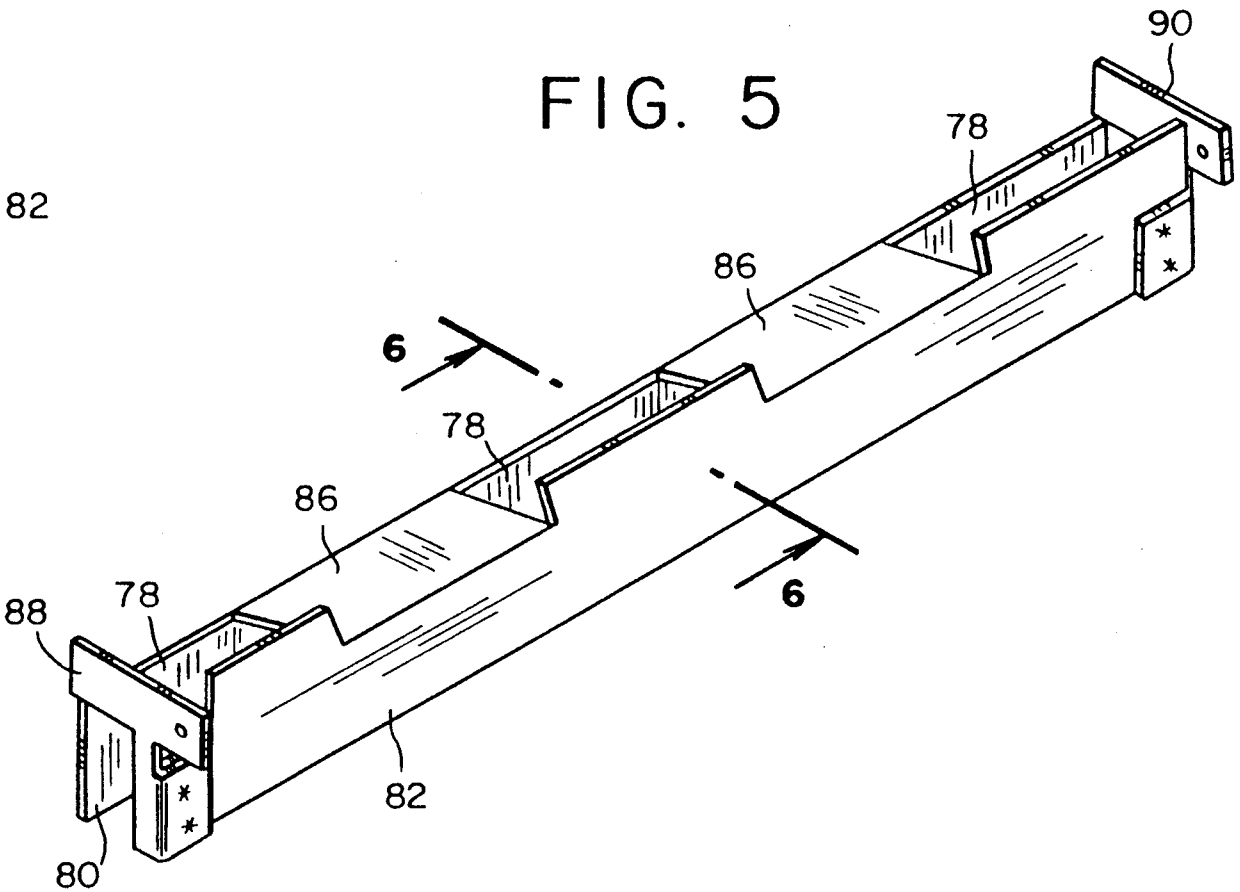
FIG. 5 is a perspective view of a component used in the gas fireplace burner assembly of the present invention.
Figure 6:
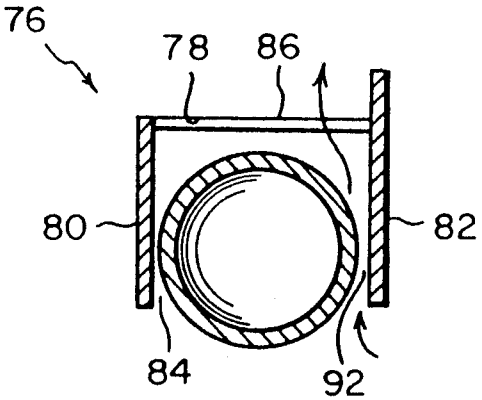
FIG. 6 is a detailed sectional view of the component shown in FIG. 5 taken along line 5—5, and illustrating its relationship to the other components of the assembly.

As more specifically shown in FIGS. 5 and 6 of the drawings, the rear flame deflector includes a pair of parallel, spaced apart front and back plates 80, 82 which define an open space 84 between them. The open space 84 is provided so that the rear burner tube portion 46 may be at least partially received by the open space.

The rear flame deflector 76 further includes a plurality of top deflector plates 86 which are joined to the front and back plates 80, 82 at the top surfaces of the front and back plates. The top deflector plates 76 extend transversely to the front and back plates to cover portions of the open space 84.

The rear flame deflector 76 further includes left and right end deflector plates 88, 90. The end deflector plates are mounted on the opposite lateral ends of the front and back plates 80, 82 and extend transversely between the front and back plates.

The top deflector plates 86 define between each other at their lateral sides and between them and the left and right end deflector plates 88, 90 flame openings 78 in the top surface of the flame deflector. These openings are particularly situated so that flames emanating from the rear burner tube portion 46 will pass through the flame openings 78 and will not impinge on either the front or rear logs 4, 6, or the transversely disposed logs 8–12 mounted on the front and rear logs.

In a preferred form, the back plate 82 of the rear flame deflector is greater in height than the front plate 80. Also, when situated over the rear burner tube portion, the rear flame deflector 76 is particularly positioned so that there is a slight spacing of about onequarter inch between the top of the rear burner tube portion 46 and the top deflector plates 86. Furthermore, the spacing between the front and back plates of the rear flame deflector, in relation to the diameter of the rear burner tube portion, is such that a spacing of preferably about one-quarter inch is provided between the rear burner tube portion 46 and the back plate 82 of the rear flame deflector. This spacing between the back plate 82 and the rear burner tube portion 46 provides a third channel 92 for secondary air to flow through.

The particular configuration of the rear flame deflector 76 and its positioning in relation to the rear burner tube portion 46 provides a much taller flame from the rear burner tube portion, and further provides more control over the flame so that it does not burn over the rear log 6. This minimizes the production of carbon monoxide, carbon and other pollutants, and prevents soot from forming on the artificial logs.

The rear flame deflector may be conveniently formed from a single blank of sheet material which may be folded or bent to the particular shape shown in FIGS. 5 and 6 of the drawings.

The gas burner assembly of the present invention further includes a gas control assembly. The gas control assembly controls the passage of the gas through the burner tube.

The gas control assembly includes a gas valve 94 which is partially disposed in the interior space defined by the log grate 16 and under the rear log 6. To protect the gas valve 94 from excessive heat, the log grate 16 may include a radiant shield 96 in the form of a metal plate situated above the gas valve and below the rear artificial log.

The gas valve is adapted to be connected to the gas piping of the house or establishment in which the gas fireplace burner assembly is to be used. A suitable valve which may be used when natural or LP gas is used in the burner assembly is Model No. 7000 MVRLC (½ PSI In, 3.5 W.C. Out for natural gas and ½ PSI In, 10.0 W.C. Out for LP gas), manufactured by Robertshaw Controls Company in Long Beach, Calif.

An extension rod 98 is coupled to the gas valve 96 and extends from the gas valve through the grate front member 14. A knob 100 is mounted on the free end of the extension rod 98 in front of the grate front member. The knob 100 allows the operator to adjust the flow of gas through the fireplace burner assembly.

The gas control assembly further includes tubing 102 between the gas valve 94 and the burner tube 42. The tubing 102 is connected to a 90° fitting 104 which, in turn, is connected to an orifice 106 which extends partially into the open end 47 of the burner tube. Gas from the gas source passes through the gas valve 94, through the tubing 102 and fitting 104 and into the orifice 106. Primary air passes through the burner tube 42 at 120 and around the orifice and mixes with the gas to flow into the burner tube.

Pilot tubing 108 is also connected to the gas valve 94 and extends to an igniter or continuous pilot assembly 110. The pilot assembly provides a continuous pilot flame, and includes a thermopile or thermogenerator 112 situated with its tip over the pilot flame, which thermogenerator is connected to a piezo igniter 114 which is mounted on the log grate front member 14 within easy reach of the operator. The piezo igniter 114 is used to light the pilot flame of the continuous pilot assembly 110. A pair of wires 116 extend between the continuous pilot assembly 110 and the gas valve 94 so that, if the thermogenerator 112 senses that the pilot flame is extinguished, the gas valve will automatically prevent gas from flowing through the pilot tubing 108 to the pilot assembly. The continuous pilot assembly will ignite the gas flowing through the burner tube, which flow may be adjusted by turning knob 100.

The gas fireplace burner assembly of the present invention produces a realistic yellow flame pattern having an appearance and distribution which is similar to the yellow flame pattern produced by a natural wood log fire, and with virtually no carbon monoxide gas, carbon or other pollutants being produced. The configuration and placement of the front flame defector 56 and the rear flame deflector 76 provide a tall yellow flame not only at the front of the fireplace assembly, as in a natural wood log fire, but also between the various artificial logs mounted 4–12 on the log grate. The deflectors also keep the flames from impinging on the artificial logs. The various channels provided for secondary air flow not only allow the burner assembly to produce a yellow flame but also control the height and direction of the flame and prevent the flame from rolling over the artificial logs.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A gas fireplace burner assembly, which comprises:

a log grate for supporting a plurality of artificial logs, the log grate being formed with a stepped configuration and having a back wall and opposite side walls joined to the back wall, each of the back wall and opposite side walls having an opening formed through the thickness thereof, the openings being dimensioned to allow secondary air to pass therethrough and into an interior space defined by the back wall and opposite side walls, the log grate further including a grate front member situated opposite the back wall;

at least a front and rear artificial log mounted on the log grate and supported thereby, the front and rear logs being arranged generally in parallel with each other;

a burner tube, the burner tube including interconnected front and rear portions disposed in a spaced apart, parallel arrangement, the rear portion being disposed at least partially below and between the front and rear logs, and the front portion being disposed at least partially below and between the grate front member and the front log;

a front flame deflector, the front flame deflector including an elongated plate-like member interposed between and spaced apart from the grate front member and the front portion of the burner tube, the front flame deflector and the grate front member, and the front flame deflector and the front burner tube portion defining first and second channels, respectively, for secondary air to flow through; and gas control means for controlling the passage of gas through the burner tube, the gas control means including a gas valve communicating with the burner tube and adapted to be coupled to a source of gas.

2. A gas fireplace burner assembly as defined by claim 1, which further comprises a rear flame deflector, the rear flame deflector being at least partially superposed over the rear burner tube portion and having a plurality of flame openings formed therein, the rear flame deflector and rear burner tube portion defining a third channel for secondary air to flow through.

3. A gas fireplace burner assembly as defined by claim 2, wherein the rear flame deflector includes spaced apart opposite front and back plates and defining an open space therebetween by which the rear burner tube portion is at least partially received, the back plate and rear burner tube portion being spaced apart from each other to define the third channel therebetween for secondary air to flow through.

4. A gas fireplace burner assembly as defined by claim 3, wherein the back plate of the rear flame deflector has a height which is greater than that of the front plate of the rear flame deflector.

5. A gas fireplace burner assembly as defined by claim 3, wherein the rear flame deflector further includes at least one top deflector plate joined to the front and back plates and extending transversely across the open space defined by the front and back plates, the top deflector plate being superposed over the rear burner tube portion and defining the flame openings on opposite lateral sides thereof.

6. A gas fireplace burner assembly as defined by claim 5, wherein the rear flame deflector further includes end deflector members situated at opposite lateral ends of the front and back plates and extending transversely across the front and back plates, the flame openings being defined between the end deflector plates and the top deflector plate.

7. A gas fireplace burner assembly as defined by claim 1, which further includes artificial ember material, the artificial ember material being situated adjacent to the front burner tube portion and being further positioned with respect to the front burner tube portion so as to be adapted to come in contact with flames emanating from the front burner tube portion to cause the artificial ember material to glow as a result thereof.

8. A gas fireplace burner assembly as defined by claim 1, wherein each of the opposite side walls of the log grate includes successively a front portion, a middle portion joined to the front portion, and a rear portion joined to the middle portion, each of the front, middle and rear portions having a different height, the front portion being lower than the middle portion, and the middle portion being lower than the rear portion to provide the log grate with a stepped configuration.

9. A gas fireplace burner assembly as defined by claim 8, wherein the middle portion and the rear portion of each of the side walls of the log grate include upwardly protruding tabs extending from an upper portion thereof, and wherein the front and rear artificial logs have a pair of openings formed therein, the openings being provided to receive the tabs of the log grate side walls to help secure the front and rear artificial logs on the log grate.

10. A gas fireplace burner assembly, which comprises:

a log grate for supporting a plurality of artificial logs, the log grate being formed with a stepped configuration and having a back wall and opposite side walls having an opening formed through the thickness thereof, the openings being dimensioned to allow secondary air to pass therethrough and into an interior space defined by the back wall and opposite side walls, the log grate further including a grate front member situated opposite the back wall, each of the side walls including a front portion, a middle portion, and a rear portion, each of which has a different height, the front portion being lower than the middle portion, and the middle portion being lower than the rear portion;

at least a front and rear artificial log mounted on the log grate and supported thereby on the middle portion and rear portion of the log grate side walls, the front and rear logs being arranged generally in parallel with each other, the middle portion and rear portion of each of the log grate side walls including a tab protruding from an upper surface thereof, which tab is received by the front and rear artificial logs to help secure the artificial logs to the log grate;

a burner tube, the burner tube including interconnected front and rear portions disposed in a spaced apart, parallel arrangement, the rear portion being disposed at least partially below and between the front and rear logs, and the front portion being disposed at least partially below and between the grate front member and the front log;

a front flame deflector, the front flame deflector including an elongated plate-like member interposed between and spaced apart from the grate front member and the front portion of the burner tube, the front flame deflector and the grate front member, and the front flame deflector and the front burner tube portion defining first and second channels, respectively, for secondary air to flow through;

artificial ember material, the artificial ember material being situated adjacent to the front burner tube portion and being further positioned with respect to the front burner tube portion so as to be adapted to come in contact with flames emanating from the front burner tube portion to cause the artificial ember material to glow as a result thereof;

a rear flame deflector, the rear flame deflector being at least partially superposed over the rear burner tube portion, the rear flame deflector including spaced apart opposite front and back plates defining an open space therebetween by which the rear burner tube portion is at least partially received, the back plate and rear burner tube portion defining a third channel therebetween for secondary air to flow through, the rear flame deflector having at least one top deflector plate superposed over the rear burner tube portion and defining flame openings on opposite lateral sides thereof; and gas control means for controlling the passage of gas through the burner tube, the gas control means including a gas valve communicating with the burner tube and adapted to be coupled to a source of gas.

* * * * *